US007814768B2

(12) United States Patent
Vecchi et al.

(10) Patent No.: US 7,814,768 B2
(45) Date of Patent: Oct. 19, 2010

(54) TEXTILE PRODUCT TREATING APPARATUS HAVING AN ULTRASONIC CLEANING DEVICE

(75) Inventors: Alexandre Vecchi, Fontanafredda (IT); Nicola Reid, Pordenone (IT)

(73) Assignee: Electrolux Home Products Corporation N.V., Zaventem (BE)

( * ) Notice: Subject to any disclaimer, the term of this patent is extended or adjusted under 35 U.S.C. 154(b) by 963 days.

(21) Appl. No.: 11/311,785

(22) Filed: Dec. 19, 2005

(65) Prior Publication Data

US 2006/0156763 A1 Jul. 20, 2006

(30) Foreign Application Priority Data

Jan. 14, 2005 (EP) ..... 05 000 647

(51) Int. Cl.
*B08B 3/12* (2006.01)

(52) U.S. Cl. ..... 68/3 R; 134/1; 134/201

(58) Field of Classification Search ..... None
See application file for complete search history.

(56) References Cited

U.S. PATENT DOCUMENTS

| | | | | |
|---|---|---|---|---|
| 1,675,140 | A * | 6/1928 | Schenderlein | 242/376.1 |
| 3,026,699 | A * | 3/1962 | Rhodes | 68/12.19 |
| 4,840,285 | A * | 6/1989 | Carr | 220/4.02 |
| 5,927,306 | A * | 7/1999 | Izumi et al. | 134/155 |
| 6,247,353 | B1 * | 6/2001 | Battenberg et al. | 73/40.5 A |
| 6,828,903 | B2 * | 12/2004 | Watanabe et al. | 340/435 |
| 7,493,781 | B2 * | 2/2009 | Ooe | 68/3 SS |
| 2002/0076221 | A1 * | 6/2002 | McDonell | 396/564 |
| 2002/0134117 | A1 | 9/2002 | Arai et al. | |
| 2003/0084535 | A1 | 5/2003 | DuVal et al. | |
| 2004/0134094 | A1 * | 7/2004 | Hahn et al. | 34/595 |
| 2005/0252540 | A1 * | 11/2005 | Ooe | 134/184 |

FOREIGN PATENT DOCUMENTS

| | | | |
|---|---|---|---|
| DE | 2512678 | A1 | 9/1976 |
| DE | 34 29 117 | A1 | 6/1986 |
| EP | 1 369 524 | A1 | 12/2003 |
| JP | 57-122889 | | 7/1982 |
| JP | 3-75089 | | 3/1991 |
| JP | 11146995 | A | 6/1999 |
| JP | 2003-245497 | | 9/2003 |
| WO | 03035961 | A2 | 5/2003 |
| WO | WO 2004/031469 | A1 | 4/2004 |

OTHER PUBLICATIONS

Takagi, Sep. 2003, JP 2003-245497, English Machine Translation.*

* cited by examiner

*Primary Examiner*—Michael Barr
*Assistant Examiner*—Jason Y Ko
(74) *Attorney, Agent, or Firm*—Pearne & Gordon LLP

(57) ABSTRACT

The invention relates to a textile product treating apparatus, in particular washing machine (1), drying apparatus or refreshing apparatus, comprising a main body (2) of the apparatus including a washing, drying and/or refreshment device; and a handheld ultrasonic cleaning device (10) comprising an ultrasonic transducer and an ultrasonic wave emitting surface, wherein the ultrasonic cleaning device is connected by a flexible hose (11) to the main body (2). According to the invention a treatment area (6) is provided covering at least a portion of the top unit (3) of the main body (2) and adapted to place a textile product (15) to be treated thereon.

28 Claims, 5 Drawing Sheets

Figures 1A, 1B, 1C:
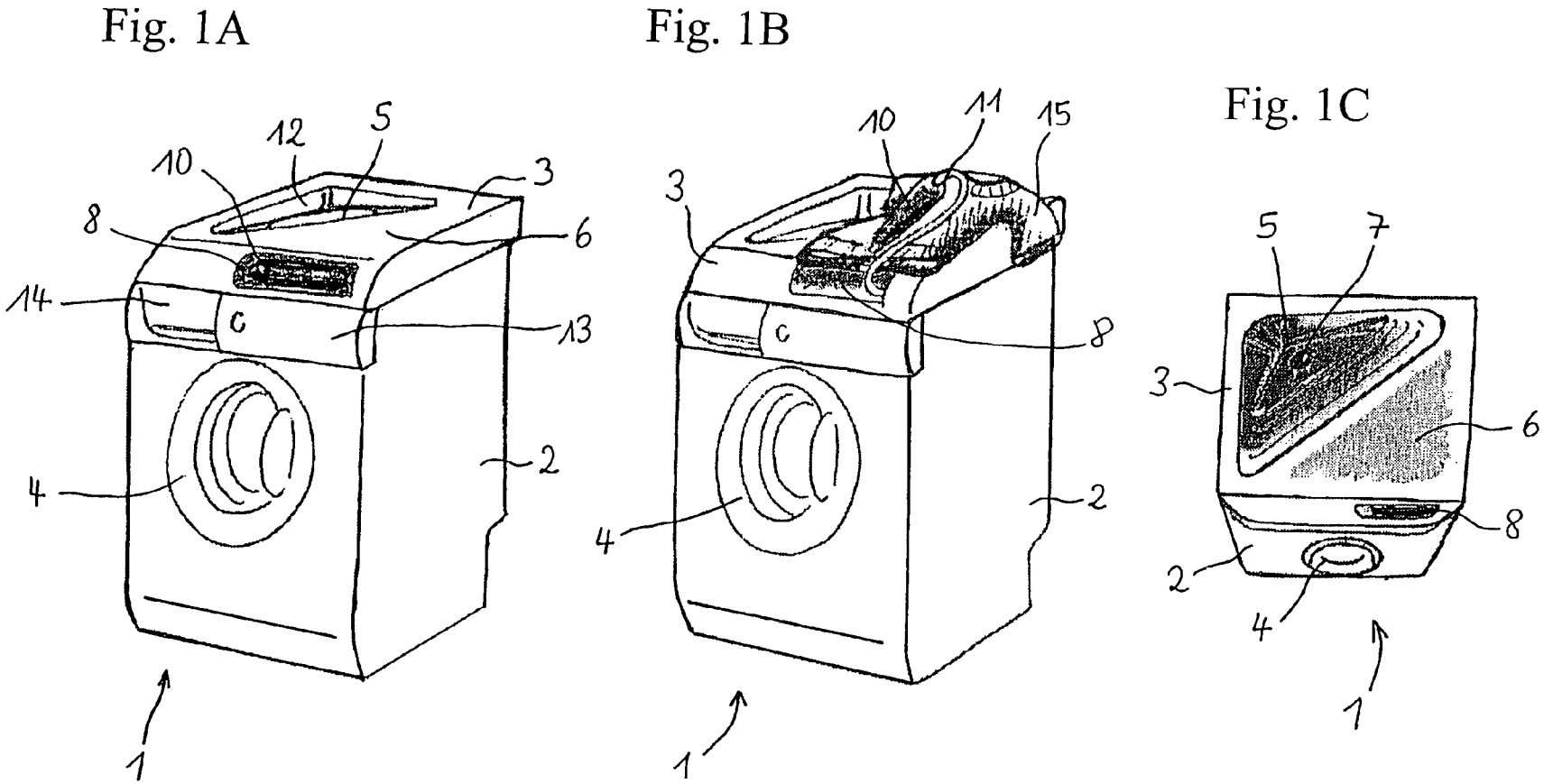

1
2
3
4
5
6
7
8
10
11
12
13
14
15

20
21
22
23
24
25
2
3
4
5
6
8

91
90

91
92
94
90

91
6
94
5
90

91
92
90

TEXTILE PRODUCT TREATING APPARATUS HAVING AN ULTRASONIC CLEANING DEVICE

The invention relates to a textile product or fabrics treating apparatus, in particular to a washing machine, a drying apparatus or a refreshing apparatus, comprising a hand-held ultrasonic cleaning device connected to a main body of the textile product treating apparatus via a flexible hose.

US 2002/0134117 A1 discloses a washing machine comprising an ultrasonic partial washing apparatus. In one embodiment the ultrasonic partial washing apparatus is stationarily mounted above the loading opening of the top loader washing machine. The sonotrode of the ultrasonic partial washing apparatus is pointing down to the opening of the washing machine and a fabrics to be cleaned by the partial washing apparatus is passed along the bottom surface of the sonotrode to clean stained areas of the fabrics. In another embodiment the partial washing apparatus is formed as a hand-held wand which is connected via a flexible hose to the washing machine. Electrical leads to the transducer within the wand and a liquid pipe connected to a nozzle in the wand run within the flexible hose such that the wand is supplied with liquid and electrical energy from the main body of the washing machine.

It is an object of the invention to provide a textile product treating apparatus having a hand-held ultrasonic cleaning device with improved amenities for the user of the ultrasonic cleaning device. It is a further object of the invention to provide a textile product treating apparatus having improved security functions when using the ultrasonic cleaning device of the apparatus.

The invention is defined in claim 1. Particular embodiments are set out in the dependent claims.

According to claim 1, a textile product or fabrics treating apparatus is provided having a main body in which the main unit for washing, drying and/or refreshing the textile product or fabrics is arranged. A hand-held ultrasonic cleaning device or partial washing device is connected to the main body via a flexible hose and may be freely moved by the user of the ultrasonic cleaning device. At least a portion of the top area of the main body is formed as a treatment area in which a stained textile product or fabric can be laid down to be cleaned by the user by pointing at the stained region of the textile product with an ultrasonic wave emitting surface of the ultrasonic cleaning device. Thereby a working space for the user is provided which does not necessitate a separate table located close to the treating apparatus for placing the textile product.

Preferably the ultrasonic cleaning device can be operated completely independent of the operation of the treating apparatus in which other textile products may be washed, dried or refreshed. For example, only the main power of the treating apparatus has to be switched on so that the washing, drying and/or refreshing device of the treating apparatus and the ultrasonic cleaning device can be operated, as far as need for cleaning exists. The textile product treating apparatus may be any type of washing machine, for example a tumbler-type washing machine including the function of a tumble dryer. Or it may be a stand-alone drying apparatus, for example a condenser dryer for drying the laundry. Or it may be a refreshing apparatus which provides a partial wash (dry washing with partial humidification of the laundry) or the like.

In a preferred embodiment a sink unit is arranged at the top portion of the main body, wherein the treatment area is part of or neighbouring the sink unit. The sink unit has a drain to discharge liquid from the sink, thereby liquid (for example water) is collected by the sink and drained out of the working area. In particular when the ultrasonic cleaning device comprises a nozzle for spraying a liquid to the textile product to be cleaned, the excessive liquid of the cleaning device and the soiled liquid are removed. Thereby for example the humidifying of the textile product can be restricted to the stained area.

In a further embodiment a basin is integrated to the sink unit for a fluid pre-treatment of the textile products, for example by a hand-wash. Also liquid may be applied to the textile by drowning the textile in the liquid stored in the basin prior to the ultrasonic cleaning using the ultrasonic cleaning device.

Preferentially the ultrasonic cleaning device is provided with a nozzle for spraying a liquid from a liquid supply device to humidify the textile product while cleaning. The liquid supply device may comprise a liquid container arranged within the ultrasonic cleaning device or it is arranged in the treating apparatus and connected to the nozzle in the ultrasonic cleaning device by a liquid conduit.

In a preferred embodiment a heater element is provided to heat the liquid supplied to the nozzle such that the cleaning efficiency may be further improved by heating the cleaning liquid prior to its application to the textile product. The heater element can be arranged within the main body of the apparatus. For example the heater element is the standard heater element of a washing machine or the like. Preferentially the heater element is arranged in the ultrasonic cleaning device and is provided as an electrical flow heater, the energy of which is supplied via conductive leads through the flexible hose from the treating apparatus.

In a further embodiment a sensor device is provided which detects the ultrasonic wave emitting surface of the ultrasonic cleaning device being in contact or in close proximity to an object (i.e. the textile product or fabrics to be cleaned) and the operation of the ultrasonic transducer is interrupted as soon as the ultrasonic wave emitting surface is not in contact or close to an object. Thereby a free emission of ultrasonic waves which may propagate to the body of the user is avoided and the security of the device in use is improved. The sensor device may be arranged at or within the ultrasonic cleaning device or may be arranged at the treatment area on the top of the main body.

In a particular embodiment the treatment surface for treating the textile product using the ultrasonic cleaning device comprises an illumination device, in particular arranged below the treatment surface, such that during ultrasonic cleaning the stained area of the textile product can be visually inspected and the cleaning result can be verified. In this case the sensor device for activating/deactivating the ultrasonic transducer preferentially comprises a photo-detecting device which is sensitive to the light emission from the illumination device. Preferably the illumination device emits a specific wavelength or a modulated light signal such that by wavelength or modulation correlation the proximity of the ultrasonic wave emission surface to the treatment surface is detected without interference from other light sources.

According to a further embodiment, the drain of the sink is connected to a liquid collecting container which collects the liquid coming from the sink and treating area. By providing the liquid container, e.g. ultrasonic cleaning liquids do not come in contact with the laundry being simultaneously cleaned in the main body of the treating apparatus. In particular, when the treating apparatus is a condenser dryer, one liquid container may be provided for collecting the liquid drained from the sink and treatment area as well as collecting water condensed from drying laundry in the condenser dryer.

In a further embodiment the liquid for ultrasonic cleaning is supplied from the main body of the treatment apparatus to the ultrasonic cleaning device and a compartment for storing a liquid or dry detergent to be added to the cleaning liquid is arranged within a drawer arranged at the main body of the treating apparatus. If the treating apparatus is for example a washing machine, one or more separate compartments or liquid containers may be provided in the conventional drawer which is provided to store the detergent for the washing cycles of the washing machine.

In a further embodiment a lid is arranged at the top of the main body which covers the sink and/or treating area on the top of the main body when not in use.

In a preferred embodiment a compartment preferentially integrated within the main body's outer shape is arranged at the main body in which the ultrasonic cleaning device can be stored when not in use. Thereby the ultrasonic cleaning device can not be damaged during transportation of the treating apparatus. Preferentially the flexible hose connecting the main body to the ultrasonic cleaning device can also be stored in the compartment which improves the optical appearance and security of the apparatus.

In a further embodiment the compartment for the ultrasonic cleaning device has its opening on the top side of the apparatus and preferentially the opening is covered by the lid for covering the sink and/or treatment area. Than all functional elements provided for ultrasonic cleaning are available or hidden when opening and closing the lid.

Figures 2A, 2B, 2C, 2D, 2E:
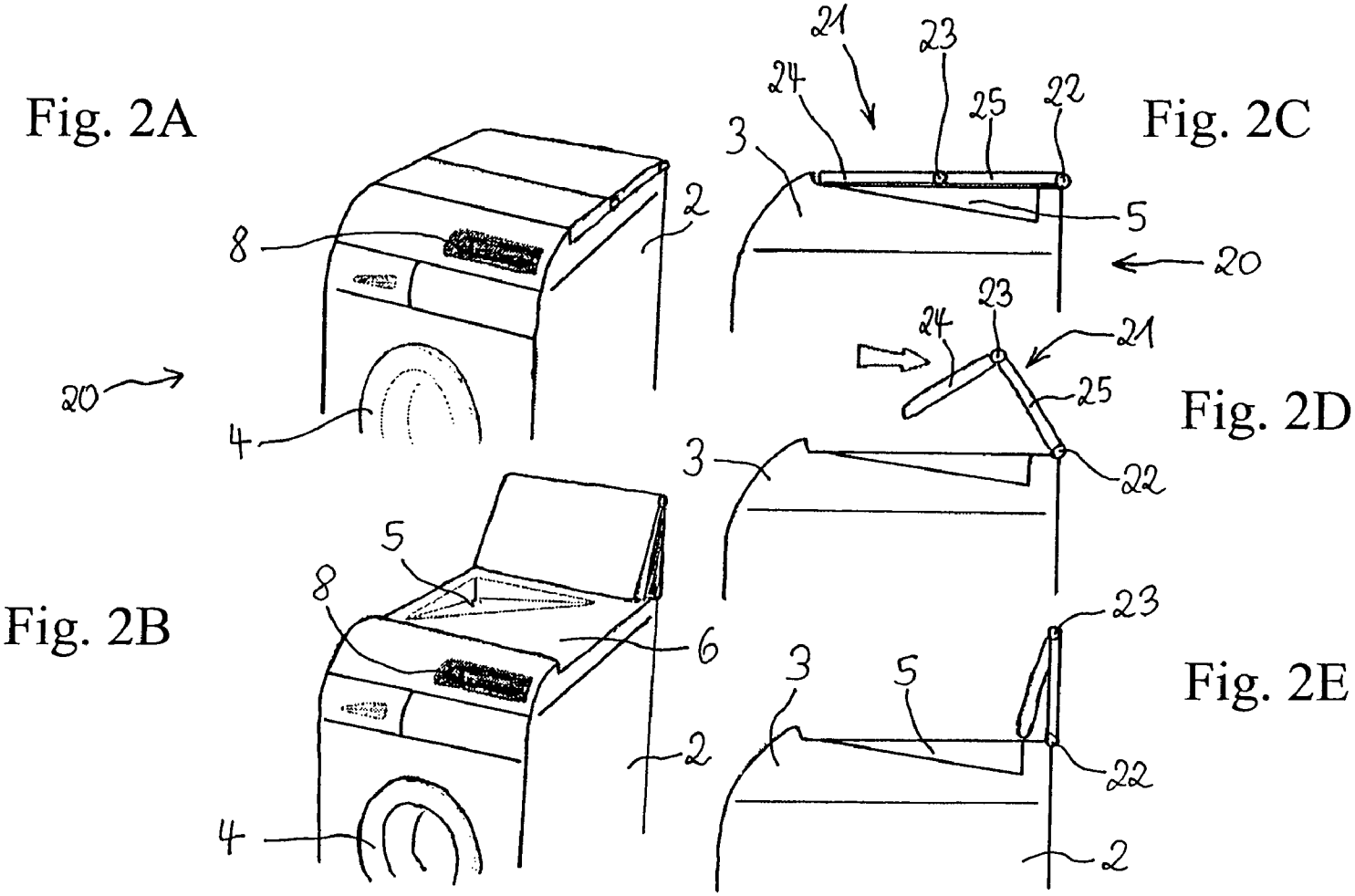
Figure 3:
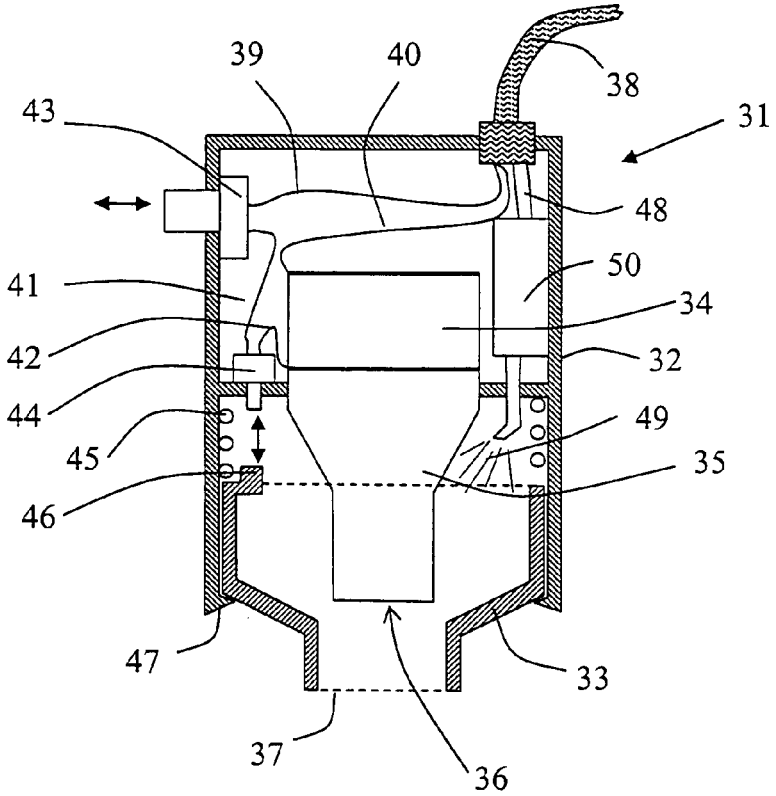
Figure 4:
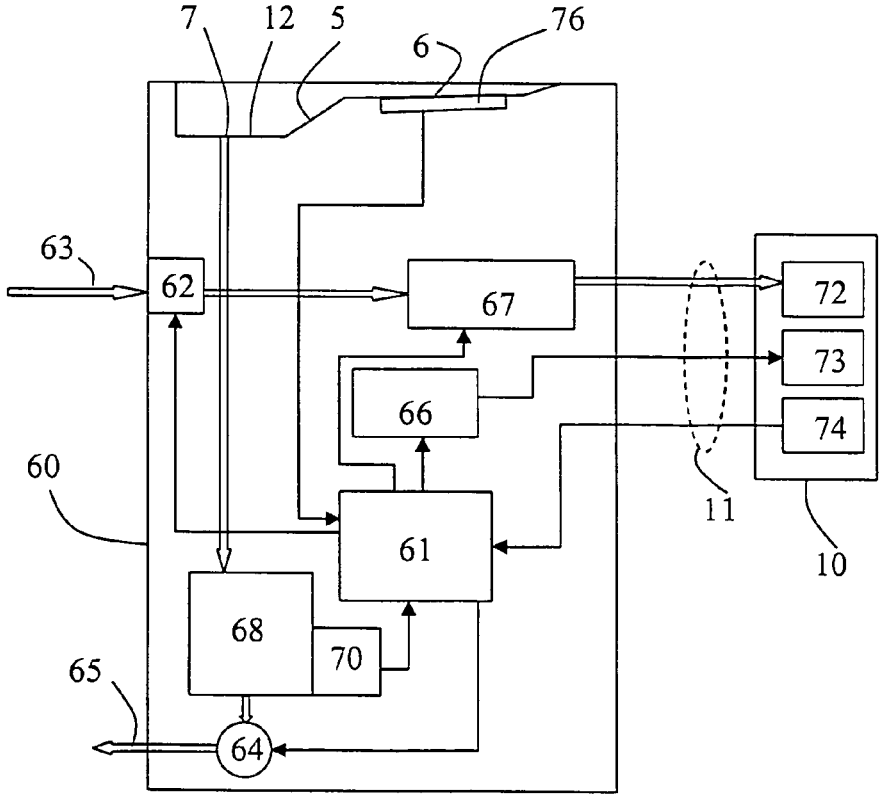
Figure 5:
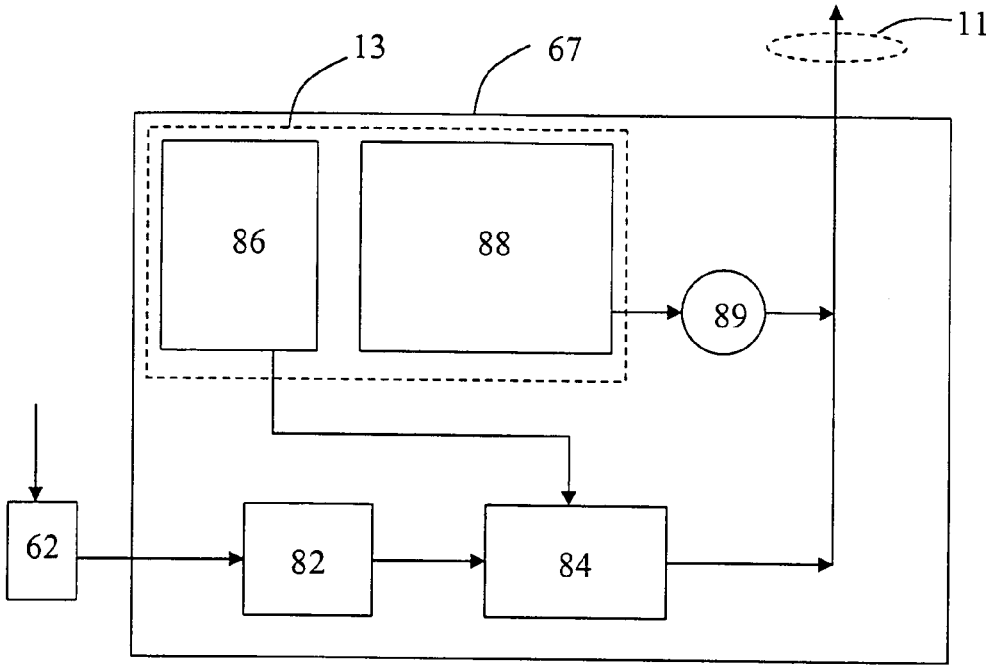

Reference is made in detail to preferred embodiments of the invention, examples of which are illustrated in the accompanying drawings. The drawings show:

FIG. 1A to 1C perspective views of the outer appearance of a washing machine having a partial ultrasonic washer according to a first embodiment, FIG. 2A and 2B partial perspective views of a washing machine according to a second embodiment, FIG. 2C to 2E simplified cross-sections of the washing machine shown in FIGS. 2A and 2B, FIG. 3 a cross-section of an ultrasonic cleaning wand, FIG. 4 a block diagram showing the interrelation of some functional elements of the washing machine, FIG. 5 a functional block diagram showing the elements of a liquid supply device supplying the liquid to the ultrasonic wand, and FIG. 6A to 6D perspective views of a washing machine according to a third embodiment.

FIGS. 1A to 1C show different perspective views of a washing machine 1 according to a first embodiment. The washing machine 1 is of the tumbler-type and has a main body 2 where a laundry loading door 4 is arranged at the front side. On the top side a top cover 3 is arranged. The top cover 3 has a triangular-shaped sink 5 and also a triangular-shaped treatment platform 6. The sink 5 has a basin section 12 and a drain 7 at the lowest point of the basin 12 such that a washing liquid may be filled into the basin 12 when the drain 7 is closed by a stopper (not shown) to temporarily hold the washing liquid within the basin 12. In the basin 12 laundry can be manually washed, for example wool laundry. Preferably the treatment platform 6 has a gradient inclined in the direction to the sink 5 such that excessive liquid used in the working area of the treatment platform 6 flows to the sink 5 and from there into the basin 12.

At the front edge of the top cover 3 a deposition compartment 8 is arranged below the outer surface of the overall body of the washing machine 1. As shown, the deposition compartment 8 has an opening and an ultrasonic wand 10 is stored within the deposition compartment 8, thereby being freely accessible through the opening. In a further embodiment not shown the deposition compartment 8 is covered by a pivotable or slideable lid or may be formed in a separate drawer. It may also be integrated in the detergent drawer which has the deposition compartment 8 as a separate compartment.

As shown in FIGS. 1A and 1B, a drawer 14 is arranged at the front side of the washing machine 1 which has compartments for storing for example powder detergents, liquid detergents, multi-component tablets and so on. As described later, additional compartments and a mixer may be provided for storing detergents and/or liquids to be provided to the ultrasonic wand 10. An operation panel 13 is also arranged at the front side of the washing machine 1 where the user can set the operation conditions and program options for the washing machine and for operating the ultrasonic wand 10 for ultrasonic cleaning and pre-treatment.

As shown in FIG. 1B, the ultrasonic wand 10 is drawn out of the deposition compartment 8 and is connected by a hose 11 to supply devices arranged at the inside of the washing machine 1. A sweater as an example for garment or a textile product is placed over the top cover 3, wherein a stained area of the sweater is positioned on the treatment platform 6 and the tip of the ultrasonic wand 10 contacts the stained area of the sweater 15. A washing liquid is sprayed onto the stained area of the sweater from the ultrasonic wand 10 through an opening at its tip and excessive liquid drains off to the sink and then through the drain 7 to the inside of the washing machine 1.

FIGS. 2A to 2E show a second embodiment of a washing machine 20. Like elements already described in connection with the first embodiment shown in FIGS. 1A to 1C are assigned to like reference numerals and only differences are described below in detail. The top cover 3 of the washing machine 20 comprises a lid 21 covering the sink 5 and the treatment platform 6 when closed (shown in FIGS. 2A and 2C). The lid 21 is mounted to the top cover 3 at its rear edge by a first hinge 22. A first plate 25 of the lid 21 is pivotable at the first hinge 22 and in the shown embodiment the lid 21 itself is foldable due to a second hinge 23 connecting the first plate 25 to a second plate 24. In alternative embodiments a single plate may be provided as a lid or more hinges may be provided for multiple foldability. If neither the sink 5 nor the treatment platform 6 are used, the lid 21 is closed and for using the sink or the treatment platform the lid 21 is folded back as shown in the sequence of FIG. 2C to FIG. 2D to FIG. 2E.

FIG. 3 shows a cross section through an exemplary embodiment of an ultrasonic wand 31. The ultrasonic wand 31 is held by a user on an outer surface of a wand body 32. At the lower end of the wand body 32 (as shown in FIG. 3) a shield member 33 is slidingly held within the wand body 32. A piezo-electrical transducer 34 connected to a horn 35 is mounted within the wand body 32. At the outer end of the horn 35 ultrasonic waves are emitted from an emitting surface 36. The horn 35 is tapering to its end portion to amplify the ultrasonic vibrations.

The shielding member 33 has an opening 37 and when the tip portion of the shield member 33 adjoining the opening 37 abuts a textile product to be cleaned, the shield member axially slides into the wand body 32. When the user pushes the wand body 32 down while the shield member 33 abuts on a textile product, the shield member 33 is pushed inwardly until the emitting surface 36 also abuts the textile product at the opening 37. In this position, a lever of a micro-switch 44 is pushed by a protrusion 46 at the inner end of the shield member 33.

The ultrasonic wand 1 is connected via a hose 38 to a washing machine, a dryer or a pre-treatment machine (not shown) which supply the electrical transducer driving signals to the piezo transducer 34 and a detergent liquid for cleaning the product. The electrical wave signal from the machine is transmitted via a first wire 39 to a push button 43 to be operated by the user, if he wants to emit the ultrasonic waves. The push button 43 is serial-connected via a third wire 41 with the micro-switch 44 and from there by a fourth wire 42 to a first metalized surface of the piezo transducer 34. A second metalized surface of the piezo transducer 34 is connected to a second wire 40 which is fed back to the hose 38 and from there to the machine where an electrical ultra wave signal generator is arranged. In another embodiment not shown the ultra wave signal generator may be arranged within the wand body 32 and in a further embodiment the power supply for the ultra wave generator is also arranged within the wand body 32.

If no compression force is applied between the shield member 33 and the wand body 32, a spiral spring 45 between the wand body 32 and the inner end of the shield member 33 pushes the shield member 33 to its outmost position where a further movement of the shield member 33 is stopped by a ledge 47 running at the inner front end of the wand body 32. In the machine connected via hose 38 to the ultrasonic wand 31 a current detector is arranged for detecting a current from the ultrasonic generator to the ultrasonic transducer 34. As soon as a current is detected, i.e. as soon as push button 43 and micro-switch 44 close their electrical contacts, a pump in the machine is activated for supplying the cleaning detergent and a detergent liquid is sprayed from a nozzle at the tip end of a conduit 48. Thereby a liquid jet 49 is sprayed through the opening 37 to humidify the textile product to be cleaned with the ultrasonic wand 31.

FIG. 4 shows a simplified block diagram of the functional elements of the washing machine shown in FIG. 1A to 1C or FIG. 2A to 2C. Reference number 60 denotes the main body including the top cover 3. As shown in FIG. 1B, the ultrasonic wand 10 is connected via flexible hose 11 to the main body. A control unit 61 within the main body 60 receives the signals from the operation panel 13 corresponding to the program options and selections selected by the user. The control unit 61 controls a valve 62 which is connected to a fresh water line 63. The valve 62 herein is not the main valve for supplying fresh water to the washing tub of the washing machine, but a separate valve for supplying fresh water to a liquid wand supply 67 from which washing liquid is supplied to the ultrasonic wand 10. The liquid wand supply 67 is described in detail below in connection with FIG. 5. In an embodiment not shown, the water supply line to the liquid wand supply 67 may also be connected to an outlet of the main (solenoid) valve which in turn is connected to the fresh water line 63.

A draining pump 64 is controlled by the control unit 61 to discharge soiled water from the washing machine. Draining pump 64 may be the main draining pump of the washing machine for also draining the washing tub or may be a separate draining pump 63 connected only to a container 68 to drain soiled liquid from this container 68. The soiled liquid is discharged via draining hose 65 to the outside of the washing machine. A level switch 70 is arranged at the container 61 and provides a level signal to the control unit 61 which, upon receipt of the level signal, activates the draining pump 64 to pump out the liquid from container 68.

An electrical wand supply 66 is also controlled by the control unit 61 and includes an ultrasonic generator providing the electrical ultrasonic driving signal for the ultrasonic transducer 34 arranged within the ultrasonic wand 10. If a heater 50 is arranged within the wand 10, a controllable voltage supply is also included in the electrical wand supply 66. Electrical leads (e.g. first and second wires 39 and 40) run from electrical wand supply 66 through the hose 11 to the ultrasonic wand 10.

In the wand 10 a nozzle unit 72 is arranged comprising the conduit 48 and the nozzle for spraying the liquid (see FIG. 3). An electric unit 73 in the wand 10 comprises the piezo transducer 34 and horn 35 having the ultrasonic emitting surface 36 as well as heater 50 and is connected via the electrical leads to the electrical wand supply 66.

A remote control unit 74 arranged within the wand 10 comprises push button 43 and micro switch 44 (range detector). In the case of the ultrasonic wand shown in FIG. 3 electric unit 73 and remote control unit 74 are integrated in one functional element, wherein the ultrasonic signal is applied to the transducer 34 in dependence of the switching state of switches 43 and 44. However, in another embodiment not shown, switching signals of use-operable switches in the wand 10 and detector signals of a detector arranged in the wand 10 may be provided from remote control unit 74 to control unit 61 which then activates/deactivates the electrical wand supply 66 and the liquid wand supply 67. For example a switch may be provided at the wand 10 which activates a valve or a pump to provide only liquid to the wand 10 which can be used to humidify the laundry on the treatment platform 6 or to fill the basin 12 with washing liquid without operating the ultrasonic transducer 34.

In addition or alternatively to the detector (herein micro-switch 44 detecting the contact of the wave emitting surface to the laundry to be cleaned) an ultrasonic detector 76 may be arranged beneath or close to the treatment platform 6 to detect ultrasonic waves emitted from the wand 10. The detected signal is supplied to the control unit 61. In this case, ultrasonic acoustic signals are periodically transmitted with low energy from the emitting surface 36, as long as the wand is not close to the detector 76, and as soon as the weak ultrasonic signals are detected by detector 76, the ultrasonic power is increased for ultrasonic treating of the laundry. As soon as the ultrasonic signal detected by the detector 76 falls below a lower threshold, emission of ultrasonic waves with high energy is stopped. Thereby, ultrasonic waves having high energy are only emitted into the direction of the treatment platform 6 and uncontrolled emission into other directions is prevented.

FIG. 5 shows a schematic block diagram of the liquid wand supply 67 shown in FIG. 4. Upon activation by the control unit 61 fresh water from the fresh water supply of the washing machine passes opened valve 62 and fresh water enters the liquid wand supply 67. The fresh water optionally passes through a softener 82 which decalcifies the water to avoid calcium carbonate deposits on the laundry to be cleaned. The water enters a mixer 84 which mixes the fresh water with a liquid or a powdery detergent stored in a first detergent compartment 86. The detergent/water mixture is output to the conduit 48 running through hose 11 to the ultrasonic wand 10. Under the control of the control unit the mixer 84 can add variable amounts of detergent to the fresh water including also adding no detergent to the fresh water. Alternatively or in addition to the water or detergent/water supply from mixer 84 a washing liquid may be supplied to the wand 10 from a second liquid compartment 88. The washing liquid is pumped by pump 89 through the conduit 48 to the wand 10.

As indicated by the dashed lines, the first detergent compartment and the second liquid compartment 88 are arranged within the drawer 14 of the washing machine. One or more of elements 82, 84, 89 and 62 can also be arranged within the drawer 14. In a further embodiment not shown a separate drawer may be provided in the washing machine for storing the ultrasonic liquids and/or ultrasonic detergent.

FIGS. 6A to 6D show different perspective views and a lid-opening sequence of a washing machine 90 according to a third embodiment. Like elements already described in connection with the first and second embodiments shown in FIGS. 1A to 2E are assigned to like reference numerals or can directly be seen from the representation and only differences are described below in detail. Here a lid 91 not only covers the sink 5 and the treatment platform 6 as in the second embodiment, but also a deposition compartment 94 for the ultrasonic wand 10 (the latter not shown here). The deposition compartment is arranged at and opened to the front upper edge of the washing machine's body. The front opening area of the deposition compartment is covered by a face plate 92 formed as a protrusion at the front edge of lid 91. Additionally a recessed grip 95 is provided between the lid 91 and the top cover of the washing machine's body to facilitate the opening of the lid.

Figures 6A, 6B, 6C, 6D:
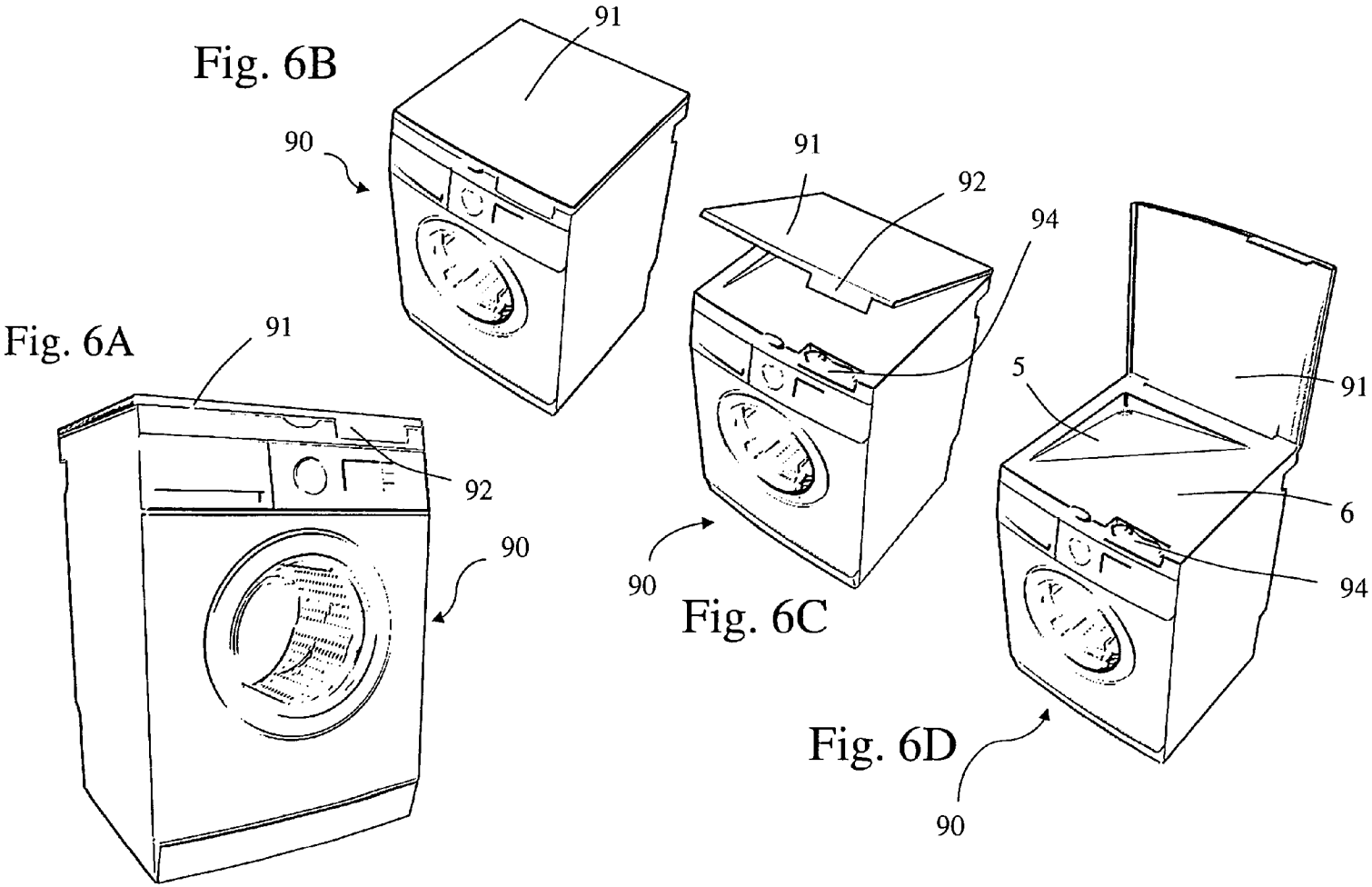

By opening the lid 91, as shown in the sequence of FIGS. 6B to 6D, access to the sink 5 and platform 6 as well as to the ultrasonic wand 10 is enabled simultaneously, and by closing the lid, the outer appearance of the washing machine is more uniform as the deposition compartment and the wand 10 are completely covered. At the same time this arrangement functions as a child-safe element as small children are unable to open the lid. To further provide resistance against an unintentional opening the closed lid 91 may be locked to the top portion of the washing machine or may be connected by a releasable snap thereto. In embodiments not shown, the opening of the deposition compartment may be arranged at the top surface of the washing machine such that the face plate 92 can be omitted, and/or the lid 91 may be foldable e.g. as shown in the second embodiment.

REFERENCE NUMERAL LIST

1 washing machine
2 main body
3 top cover
4 door
5 sink
6 treatment platform
7 drain
8 deposition compartment
10 ultrasonic wand
11 hose
12 basin
13 operation panel
14 drawer
15 sweater
20 washing machine
21 lid
22 first hinge
23 second hinge
24 second plate
25 first plate
31 ultrasonic wand
32 wand body
33 shield member
34 piezo-electrical transducer
35 horn
36 emitting surface
37 opening
38 hose
39 first wire
40 second wire
41 third wire
42 fourth wire
43 push button
44 micro-switch
45 spiral spring
46 protrusion
47 ledge
48 conduit
49 liquid jet
50 heater
60 main body
61 control unit
62 valve
63 fresh water line
64 draining pump
65 draining hose
66 electric wand supply
67 liquid want supply
68 container
70 lever switch
72 nozzle unit
73 electric unit
74 remote control unit
76 ultrasonic detector
82 softener
84 mixer
86 first detergent compartment
88 second liquid compartment
89 liquid pump
90 washing machine
91 lid
92 face plate
94 deposition compartment
95 recessed grip

The invention claimed is:

1. Textile product treating apparatus, in particular washing machine (1, 20), drying apparatus or refreshing apparatus, comprising:

a main body (2, 60) of the apparatus including a washing, drying and/or refreshment device;

a handheld ultrasonic cleaning device (10, 31) comprising an ultrasonic transducer (34) and an ultrasonic wave emitting surface (36), wherein the ultrasonic cleaning device is connected by a flexible hose (11) to the main body (2, 60);

a treatment area (6) covering at least a portion of a top surface (3) of the main body (2, 60) and adapted to place a textile product (15) to be treated thereon for treatment by the handheld ultrasonic cleaning device;

a liquid supply device (67);

a nozzle (72) coupled to the handheld ultrasonic cleaning device and connected to the liquid supply device (67) for spraying a liquid onto a textile product being treated on the treatment area;

a sink unit (5) separate from the treatment area and arranged at the top surface (3) of the main body (2, 60), wherein the sink unit comprises a drain (7) for discharging a liquid from the sink unit and the treatment area (6); and a deposition compartment adapted to store the handheld ultrasonic cleaning device (10, 31), wherein the deposition compartment is arranged at and opened to a front surface of the main body.

2. Apparatus according to claim 1, wherein the sink unit (5) comprises a basin (12) including the drain (7).

3. Apparatus according to claim 1 wherein the ultrasonic cleaning device (10, 31) or the apparatus (1, 20) comprises a heater element (50) adapted to heat the liquid supplied to the nozzle.

4. Apparatus according to claim 1, comprising a sensor device (44) adapted to detect said ultrasonic wave emission surface (36) being in contact or in close proximity to an object and to provide a detection signal, and a control device (61) connected to the sensor device and adapted to stop the operation of said ultrasonic transducer (34), when the detection signal is not provided.

5. Apparatus according to claim 4, wherein the sensor device (44) is a switch arranged within a body (32) of said ultrasonic cleaning device (10, 31) and said control device comprises a switchable contact of the switch, a position detector adapted to detect the variable position of the ultrasonic wave emitting surface (36) being close to or at the opening (37), or a proximity switch adapted to detect a distance between the ultrasonic wave emitting surface (36) and an object.

6. Apparatus according to claim 5, said body (32, 33) comprising at least two parts, wherein a tip body part (33) comprising said opening is movably arranged at a main body part (32), and wherein said sensor device (44) is adapted to detect at least one position of the tip body part relative to the main body part.

7. Apparatus according to claim 4, wherein the sensor device (44) is an orientation sensor, in particular a gravity sensor, adapted to output the detection signal when the tip of the ultrasonic cleaning device (10, 31) is pointing in a space direction of a predetermined range, in particular in downward or nearly downward direction.

8. Apparatus according to claim 4, wherein the sensor device is an ultrasonic sensor (76) adapted to detect reflected or transmitted ultrasonic waves emitted from the ultrasonic wave emitting surface (36).

9. Apparatus according to claim 8, wherein the ultrasonic sensor (76), including in particular a piezoelectric foil, is arranged at the treatment area (6).

10. Apparatus according to claim 1, wherein said treatment area (6) comprises an illumination device.

11. Apparatus according to claim 4, wherein the sensor device (44) is a photo detecting device.

12. Apparatus according claim 1, comprising a liquid container (68) connected to the drain (7) of the sink (5).

13. Apparatus according to claim 12, wherein the apparatus (2, 60) is a condenser dryer and the liquid container (68) is adapted to collect condensed water.

14. Apparatus according to claim 12, wherein a liquid level sensor (70) is assigned to the container (68).

15. Apparatus according to claim 14, wherein a draining pump (64) is connected to the container (68) or to the drain (7), activated in particular upon receipt of a signal from the liquid level sensor (70) of claim 16.

16. Apparatus according to claim 1, wherein the liquid supply device (67) is connected to a fresh water supply line (63) and/or comprises a supply pump (89).

17. Apparatus according to claim 1, wherein the liquid supply device (67) comprises a detergent mixing member (84).

18. Apparatus according to claim 1, wherein the liquid supply device (67) comprises a detergent compartment (86, 88).

19. Apparatus according to claim 18, wherein the detergent compartment (86, 88) is arranged in a drawer (14), in particular a drawer for storing the ultrasonic cleaning device and/or detergents for the textile treating apparatus (1, 20).

20. Apparatus according to claim 1, wherein the liquid supply device (67) comprises a softener member (82) adapted to decalcify fresh water.

21. Apparatus according to claim 1, wherein the liquid supply device (67) comprises an activation member (61) adapted to activate supply of liquid to the nozzle of the ultrasonic cleaning device (10, 31).

22. Apparatus according to claim 21, wherein the activation member comprises a detector adapted to detect the operation of the ultrasonic transducer (34).

23. Apparatus according to claim 1, comprising a lid (21) adapted to cover the treatment area (6) and/or the sink (5).

24. Apparatus according to claim 23, wherein the lid (21) is foldable.

25. Apparatus according to claim 1, wherein the deposition compartment is at least partially arranged within a top cover of the apparatus.

26. Apparatus according to claim 25, wherein the treatment area and the sink unit configured to collect liquid are also arranged within a top cover of the apparatus.

27. Textile product treating apparatus, in particular washing machine, drying apparatus or refreshing apparatus, comprising:

a main body of the apparatus including a washing, drying and/or refreshment device;

a handheld ultrasonic cleaning device comprising an ultrasonic transducer and an ultrasonic wave emitting surface, wherein the ultrasonic cleaning device is connected by a flexible hose to the main body;

a treatment area provided at a top surface of the main body and adapted to place a textile product to be treated thereon for treatment by the handheld ultrasonic cleaning device;

a liquid supply device;

a nozzle coupled to the handheld ultrasonic cleaning device and connected to the liquid supply device for spraying a liquid onto a textile product being treated on the treatment area;

a deposition compartment adapted to store the handheld ultrasonic cleaning device, wherein the deposition compartment is arranged at and opened to a front surface of the main body;

a sink unit separate from the treatment area and arranged at the top surface of the main body in fluid communication with the treatment area; and a lid provided at the top surface of the main body and removably positioned over the treatment area and sink unit such that the lid can cover the treatment area and sink unit when not in use.

28. Apparatus according to claim 27, wherein the sink unit comprises a drain for discharging a liquid from the sink unit and the treatment area.

* * * * *